US006227256B1

(12) United States Patent
Quigley

(10) Patent No.: US 6,227,256 B1
(45) Date of Patent: May 8, 2001

(54) MULTI-LAYER PAPERMAKING FABRIC HAVING LONG WEFT FLOATS ON ITS SUPPORT AND MACHINE SURFACES

(75) Inventor: Scott Quigley, Townville, SC (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/460,360

(22) Filed: Dec. 13, 1999

(51) Int. Cl.[7] ..... D03D 13/00; D21F 1/10
(52) U.S. Cl. ..... 139/383 A; 442/208
(58) Field of Search ..... 139/383 A; 442/207, 442/203, 208

(56) References Cited

U.S. PATENT DOCUMENTS

| | | | | |
|---|---|---|---|---|
| 4,709,732 | | 12/1987 | Kinnunen . | |
| 4,739,803 | | 4/1988 | Borel . | |
| 5,025,839 | | 6/1991 | Wright . | |
| 5,052,448 | | 10/1991 | Givin . | |
| 5,054,525 | | 10/1991 | Vohringer . | |
| 5,067,526 | | 11/1991 | Herring . | |
| 5,487,414 | | 1/1996 | Kuji et al. . | |
| 5,544,678 | * | 8/1996 | Barrett | 139/383 A |
| 5,555,917 | | 9/1996 | Quigley . | |
| 5,694,980 | * | 12/1997 | Quigley | 139/383 A |
| 5,713,397 | | 2/1998 | Quigley . | |
| 5,988,229 | * | 11/1999 | Quigley | 139/383 A |
| 6,148,869 | * | 11/2000 | Quigley | 139/383 A |

* cited by examiner

*Primary Examiner*—Andy Falik
(74) *Attorney, Agent, or Firm*—Pitney, Hardin, Kipp & Szuch LLP

(57) ABSTRACT

A wear resistant dual layer papermaking fabric, of stable construction, having a fiber support surface and a machine contact surface. The fabric comprises first picks of weft yarn are woven with warp yarns to form weft yarn floats of equal length arranged in a twill pattern diagonally over the support surface. Second picks of weft yarn are woven with the warp yarns to form weft yarns floats of equal length arranged in a twill pattern diagonally across the contact surface. The weave pattern provides that the warp yarns inter-engage with the first and second picks in a balanced weave pat parallel and stable.

22 Claims, 15 Drawing Sheets

110
114
118
112
116
09
010
011
012
013
014
015
016

01
02
03
04
05
06
07
08
B
210
212
214
215
216
218
220

210
220
220
8
214
218
212
216
09
010
011
012
013
014
015
016

MULTI-LAYER PAPERMAKING FABRIC HAVING LONG WEFT FLOATS ON ITS SUPPORT AND MACHINE SURFACES

BACKGROUND OF THE INVENTION

The present invention is directed to a dual layer papermaking fabric which provides even drainage throughout and in which both the paper support surface and the machine contact surface are weft dominant surfaces.

Normally, dual layer papermaking fabrics are woven with a single set of warp threads, upper layer weft threads and lower layer weft threads. Normally, the number of upper layer weft threads is twice that of the lower layer weft threads. It is also desirable to have long weft floats on the paper support surface to provide a smooth surface with adequate permeability. The machine contact surface also preferably comprises long weft floats also for adequate permeability and further for protecting the warp threads against wear through excessive contact with the machine rolls.

Papermaking fabrics developed with these features in mind are disclosed in U.S. Pat. Nos. 4,739,803; 4,709,732; 5,025,839; 5,487,414; and 5,555,917.

The instant invention has for its object, a papermaking fabric having a paper support surface which is smooth so as to reduce fabric marking on the paper to a minimum.

Another object of the invention is a papermaking fabric having a paper support surface having machine direction crossover forming balanced twill lines which provide a minimum number of uniform markings on the paper.

Another object of the invention is providing a papermaking fabric having a minimum number of the warp threads exposed on the outer fabric surfaces providing increased wearability and improved uniformity.

Another object of the invention is a papermaking fabric which maintains even drainage during use.

Another object of the invention is a papermaking fabric having stabilized machine contact surface floats.

Another object of the invention is a papermaking fabric having stabilized support surface floats.

Another object of the invention is a papermaking fabric in which the warp crossovers on the paper support surface and the warp cross-unders on the machine contact surface form diagonal twill lines across each fabric surface.

Another object of the invention is a multi-layer papermaking fabric in which the weaves of each fabric layer are balanced.

SUMMARY OF THE INVENTION

The instant invention is directed to a multi-layer papermaking fabric which utilizes a single set of MD (machine direction) yarns. The fabric includes a lower CMD (cross machine direction) layer having a selected number of yarns per inch and an upper CMD layer having a selected number of yarns per inch which are at least twice that of the lower CMD layer. A system of MD yarns are interwoven with the upper and lower CMD yarns in a repeated weave pattern. Preferably the number of upper CMD yarns is twice the number of lower CMD yarns.

The weave pattern requires that each MD yarn weave to cross-under an even number of lower CMD yarns and to crossover an uneven number of upper CMD yarns with the number of upper CMD yarn crossovers being three fifths of the CMD yarn crossovers and cross-unders. The MD yarn and the CMD yarn crossovers and cross-unders are arranged in twill arrays diagonally across the width of the weave pattern.

Selected of the CMD yarn floats of the upper surface are tied in with a single crossover of a MD yarn at each end within the weave pattern while other of the CMD yarn floats are tied in with a single crossover of a MD yarn only at one end, within the weave pattern. These other of the CMD yarn floats are arranged between the selected CMD yarn floats throughout the weave pattern.

It is preferred that the uneven number of crossovers of each MD yarn comprises three. Also, it is preferred that each of these crossovers cross over only one CMD yarn. It is also preferred that certain of these crossovers of each of the MD yarns are separated by at least ten CMD yarns while others of these crossovers are separated by as few as two of the CMD yarns per weave pattern repeat.

On the machine or lower surface, each of the CMD yarns forms only one float which passes beneath a majority of the MD yarns for each weave pattern repeat. These lower surface CMD floats are tied in with a plurality of consecutive MD yarns which successively pass under, over and under each CMD yarn forming a tie end point at one end of the CMD float. The tie end points form twill lines diagonally across the lower surface of the weave pattern.

The weave requires selected of the upper CMD yarns to cross under selected MD yarns and form a cross-under which appears on the lower surface. The weave does not allow a lower CMD yarn to appear on the upper surface.

The weave pattern, which produces a CMD yarn dominated support and machine surfaces utilizes sixteen MD yarns per weave pattern repeat. There are forty-eight CMD yarns per weave pattern repeat. It is preferred that the CMD yarns are of equal size. The CMD yarns forming the support surface may be of a different diameter than the CMD yarns forming the contact surface. Also, the CMD yarns forming the support surface may be of multiple sizes.

Each of the CMD yarns forming the contact surface is stacked beneath selected of the CMD yarns forming the support surface. These selected CMD yarns are each separated from each other by a single support surface CMD yarn.

DESCRIPTION OF THE DRAWINGS

The invention will be more readily understood from a reading of the following specification and by reference to the accompanying drawings forming a part thereof, wherein examples of the invention are shown:

FIGS. 3-1 and 3-2 are side sectional views showing the relationship of each warp and weft yarn throughout a single repeat of the weave pattern;

FIGS. 7-1 and 7-2 are side sectional views showing the relationship of each warp and weft yam of the alternative arrangement throughout a single repeat of the weave pattern;

FIGS. 11-1 and 11-2 are side sectional views showing the relationship of each warp and weft yarn throughout a single repeat of the weave pattern of the second alternative arrangement; and, FIG. 12 is a weave diagram for the second alternative arrangement of the papermaking fabric of the invention through a repeat of the weave pattern.

DESCRIPTION OF A PREFERRED EMBODIMENT

Figure 1:
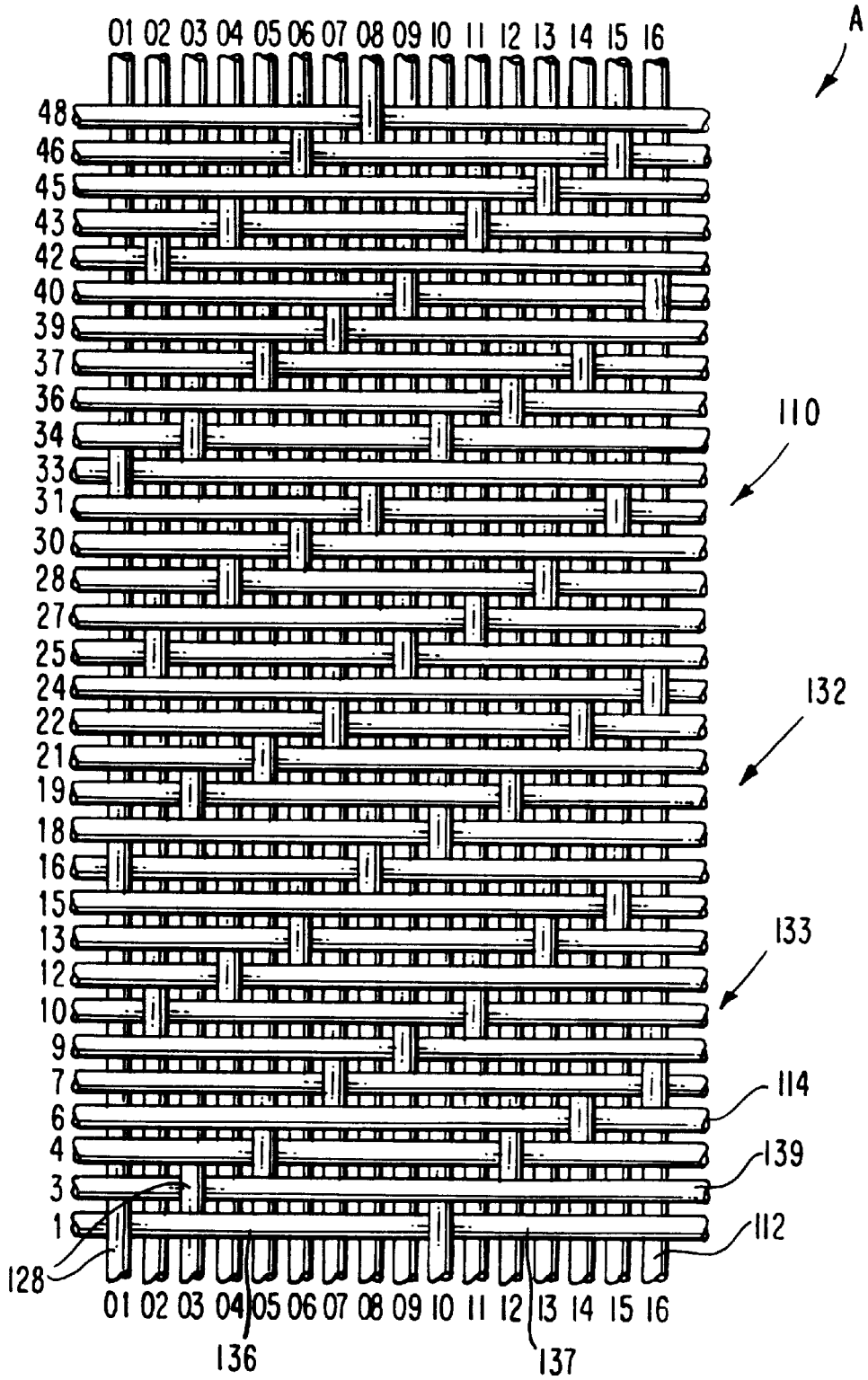
FIG. 1 is a sectional top view of the paper support surface of the papermaking fabric of the invention through a single repeat of the weave pattern.
Figure 2:
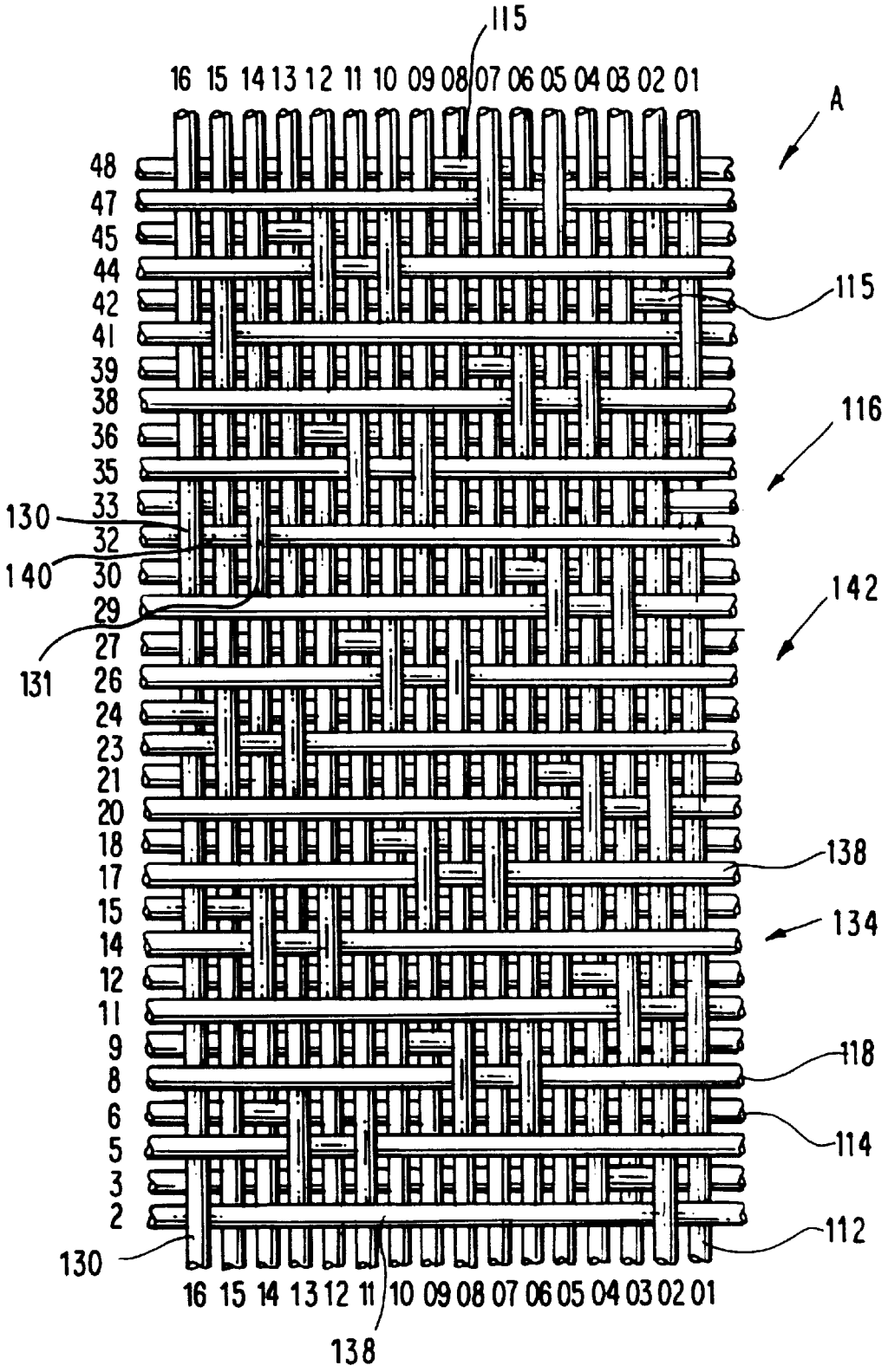
FIG. 2 is a sectional bottom view of the machine contact surface of the papermaking fabric of the invention through a single repeat of the weave pattern.

Turning now to the drawings; FIG. 1 shows a full repeat of the weave pattern forming the paper support surface 110 of papermaking fabric A of the invention. As shown there are sixteen warp yarns 112, numbered 1-16, which are controlled by sixteen harness frames in the usual manner to weave with upper layer weft yarn 114 to form the upper fabric layer which forms the paper support surface 110. FIG. 2 shows the same warp yarns 112 weaving with lower layer weft yarn 118 to form the lower fabric layer which forms the machine contact surface 116.

Figure 4:
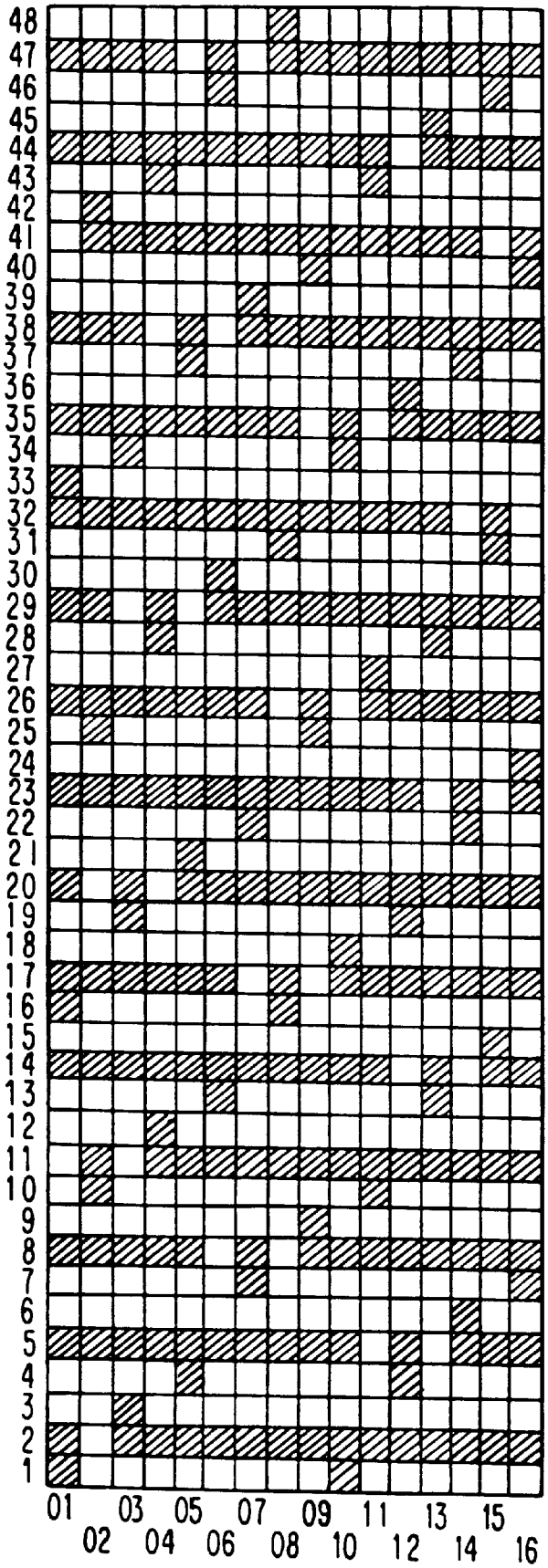
FIG. 4 is a weave diagram for the papermaking fabric of the invention through a repeat of the weave pattern.

The complete weave pattern, as shown in FIG. 4, depicts sixteen warp yarns weaving with forty-eight picks of weft yarn to form the complete repeat of the weave pattern. Preferably the warp and weft yarns are formed of monofilament polyester yarns ranging in diameters of between 0.0032 to 0.0450 inches. Preferably, the diameter of the warp yarn is about 0.0050 inches and the diameter of weft yarns 114 and 116 is about the same. Optionally, upper weft yarns 114 forming support surface 110 may be smaller or larger than the warp yarns by about 0.0020 inches while lower weft yarns 118 forming contact surface 116 may be larger in diameter than the warp yarns by about 0.020 inches. The upper weft yarns may be of single diameter or of plural diameters.

Other materials are acceptable for forming the warp yarns and one or both of the weft yarns may comprise polyamide, polyetherketone or blends thereof. Also, multifilament yarns may be used.

Figures 1, 3:
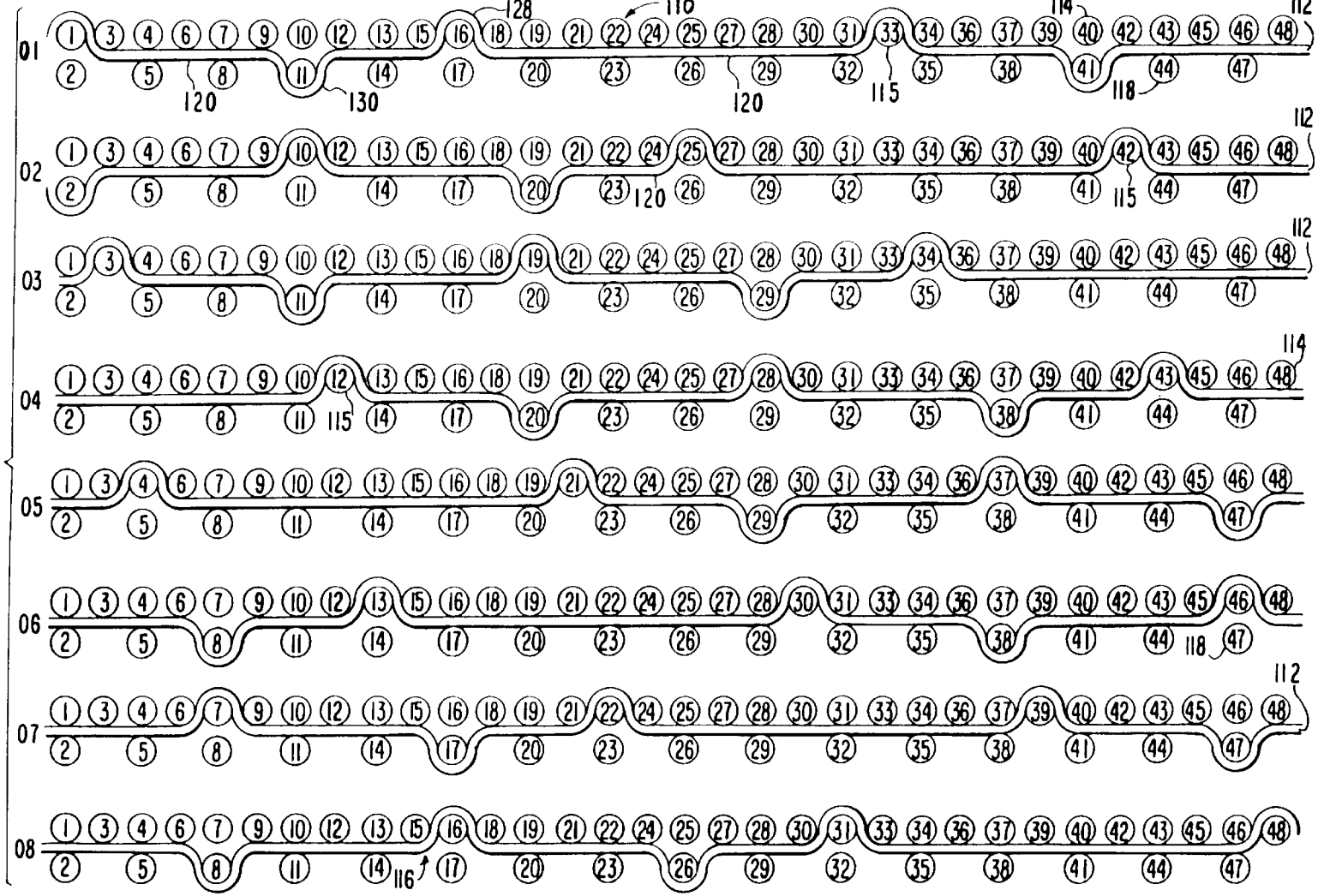
Figures 2, 3:
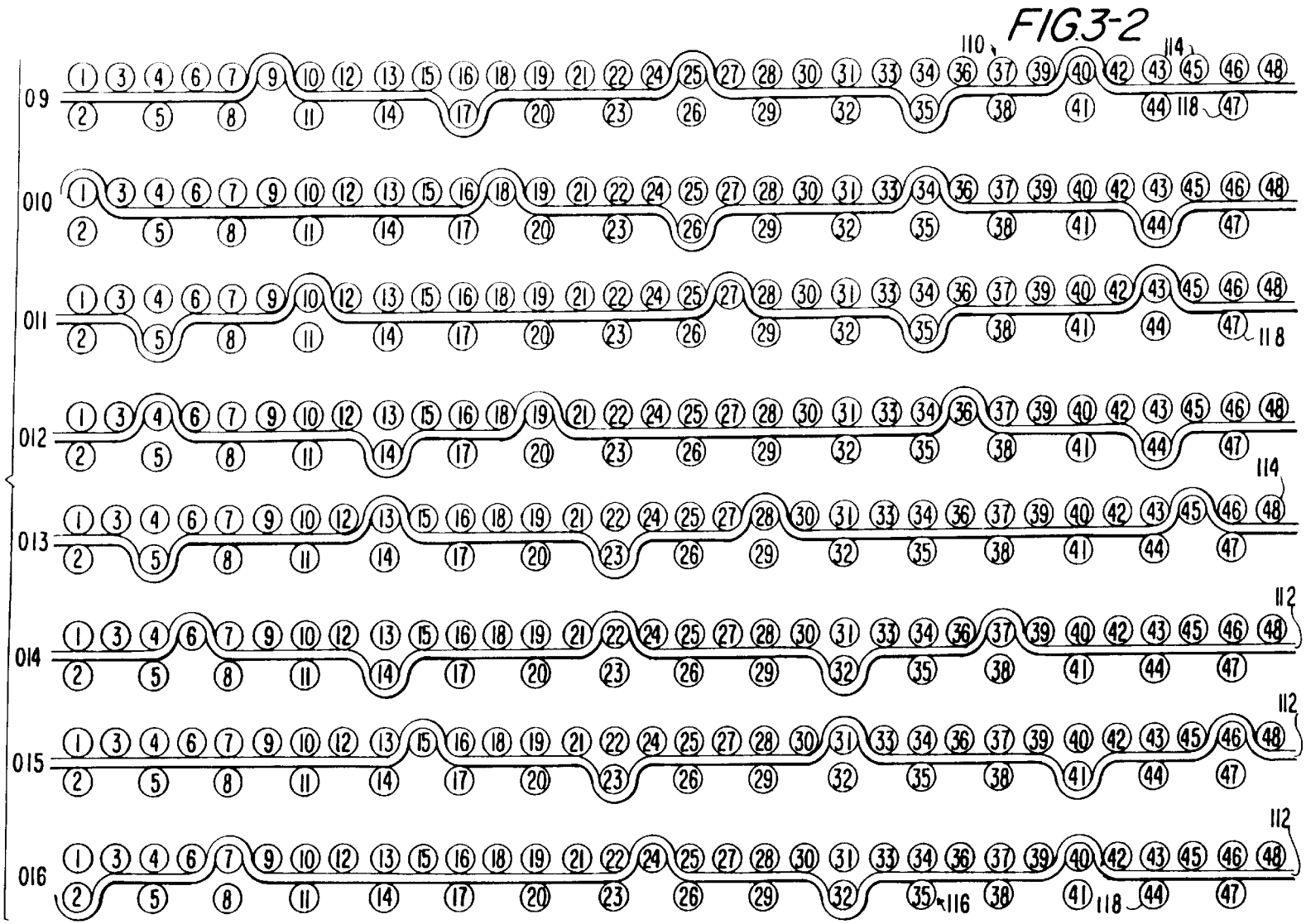

Turning now to FIGS. 1, 2, 3-1 and 3-2, it can be seen that warp yarns 112 are arranged as a single set which weaves with both the upper layer weft yarn 114 to form the paper support surface 110 and the lower layer of weft yarns 118 to form the machine contact surface 116. FIG. 3 clearly shows that each warp yarn 112 of the weave pattern repeat weaves over only three spaced picks of weft yarn 114 on the paper support surface per repeat of the weave pattern. By way of example warp yarn 01 of warp yarns 112 weaves to cross-over only picks 1, 16, and 33 of the weft yarns, while passing beneath the remaining upper layer weft yarns 114. Warp yarn 1 also weaves to pass over all lower weft yarns 118 through the weave pattern, except where it weaves twice to pass beneath lower layer picks 11 and 41. Likewise warp yarn 2 of warp yarns 112 is controlled to pass over only upper layer picks 10, 25 and 42 and to pass under only lower layer picks 2 and 29 through a repeat of the weave pattern. Warp yarns 3–16 weave in similar manner as shown in the drawing.

It should be noted that no lower layer weft yarns 118 appear on support surface 110 as each pick of weft yarn 118 is stacked beneath alternate picks of upper weft yarn 114. Also, substantially all of the picks of upper weft yarn 114 appear only on support surface 110 and not on machine contact surface 116. However, each pick of upper layer weft yarn 114 includes an uncovered cross-under 115 which appears as a single point along each warp yarn on contact surface 116. While these weft yam cross-unders 115 appear on the machine contact surface 116 they remain elevated above cross-unders of warp yarns 112 and the lower weft yarns 116 and are, therefore, not engaged when the contact surface is in machine contact. Examples of upper layer weft cross-unders 115 which appear on the machine contact surface are warp 01, pick 33; warp 02, pick 42; and warp 03, pick 3.

The weave pattern provides a balanced construction in which the warp yarns form a plurality of inner floats 120 along each of warp yarns 1–16 of warp 112. As best seen in FIG. 3, these inner floats are relatively short, passing beneath four and above two picks of lower weft yarn 118; beneath five and above two picks of lower weft yarn 118; beneath ten and above five picks of lower weft yarn 118; beneath three and above one pick of lower weft yarn 118 along warp yarn of warp 112 throughout the weave pattern.

The weave pattern, as shown in FIGS. 1–4, provides an upper paper support surface 110 in which the warp crossovers, indicated at 128 are: arranged in diagonal rows or twill lines 132 across the support surface. The weave pattern also provides that alternative picks of weft yarn 114 forming the upper layer form a pair of weft floats 136, 137 across the width of the weave pattern. Intermediate picks of weft yarn 114 are woven with warp yarns 112 to form extended floats 139 which pass over fifteen warp yarns 112 and are tied in with only a single crossover 128 per weave pattern repeat. Floats 136, 137 which pass over eight and six adjacent warp yams respectively along with floats 139 form twill lines 133 across the fabric width.

By locating the warp crossovers 128, which tie down opposed ends of the weft floats 136, 137, and 139, in staggered positions located along opposite sides of intermediate sections of weft floats 139, these weft floats are stabilized along their length and are retained along their transverse axis in substantially parallel positions relative the other floats. In addition to promoting even drainage, the stabilized floats provide for a more even or uniform support surface which reduces marking of the paper product supported thereon. Likewise, the twill lines 132 produce minimal markings while forming a pleasing pattern.

The warp cross-unders 130, 131 on the machine contact surface 116 are positioned along diagonal rows forming twill lines 134 across the weave pattern. The weft floats 138, are of extended length with only one float being formed for each pick across the width of the weave pattern, and are arranged in diagonal rows forming twill lines 142. Each float is anchored at one end in each weave pattern by a pair of warp cross-unders 130, 131 which are separated by warp cross-over 140. These tie in points are formed by adjacent warp yams 112 and securely anchor an end of the extended floats. Again, cross-unders 130, 131 are arranged to be positioned along intermediate portions of opposing sides of floats 138 further stabilizing and maintaining the floats in position.

Figure 5:
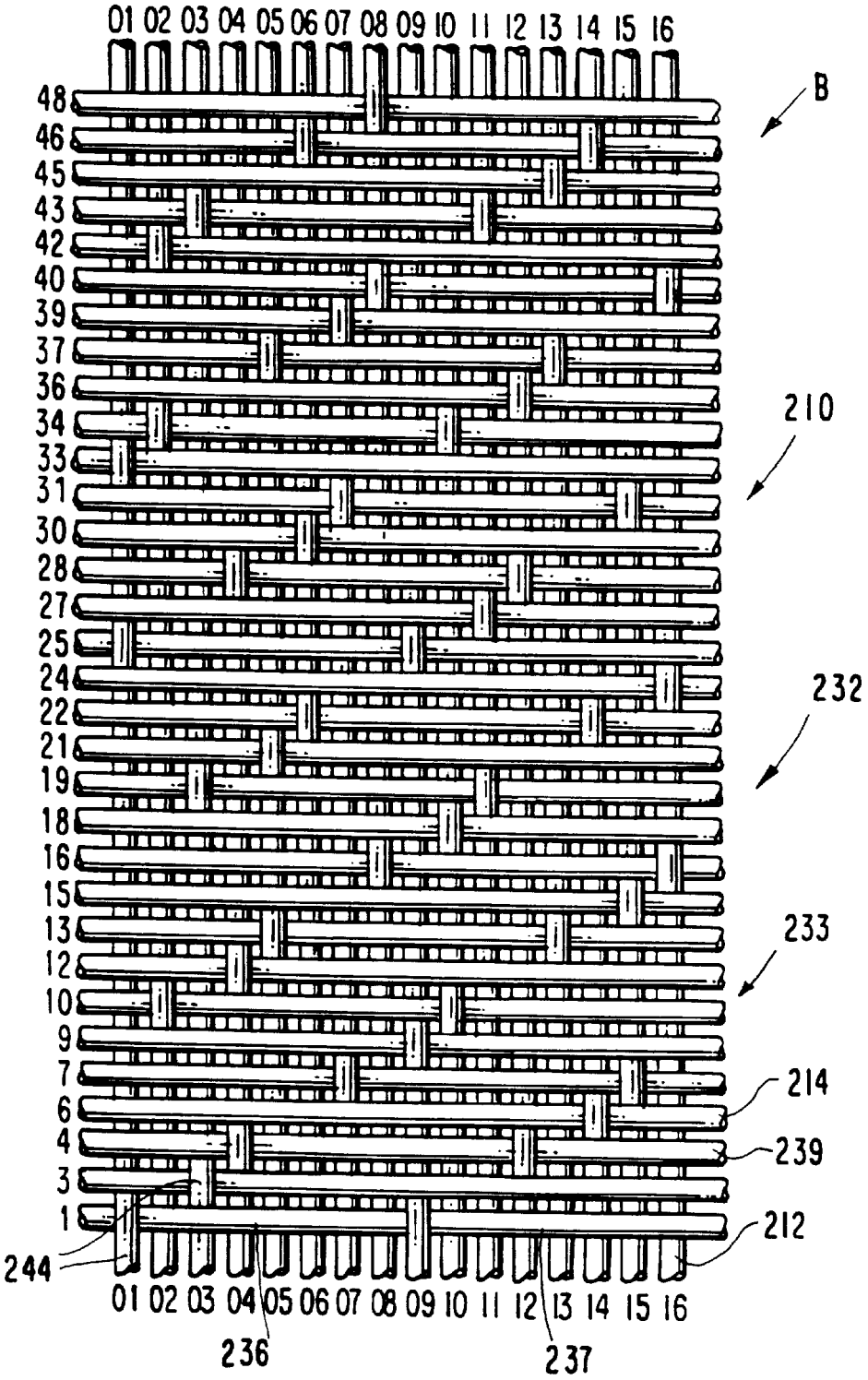
FIG. 5 is a sectional top view of the paper support surface of an alternative arrangement of the papermaking fabric of the invention through a single repeat of the weave pattern.
Figure 6:
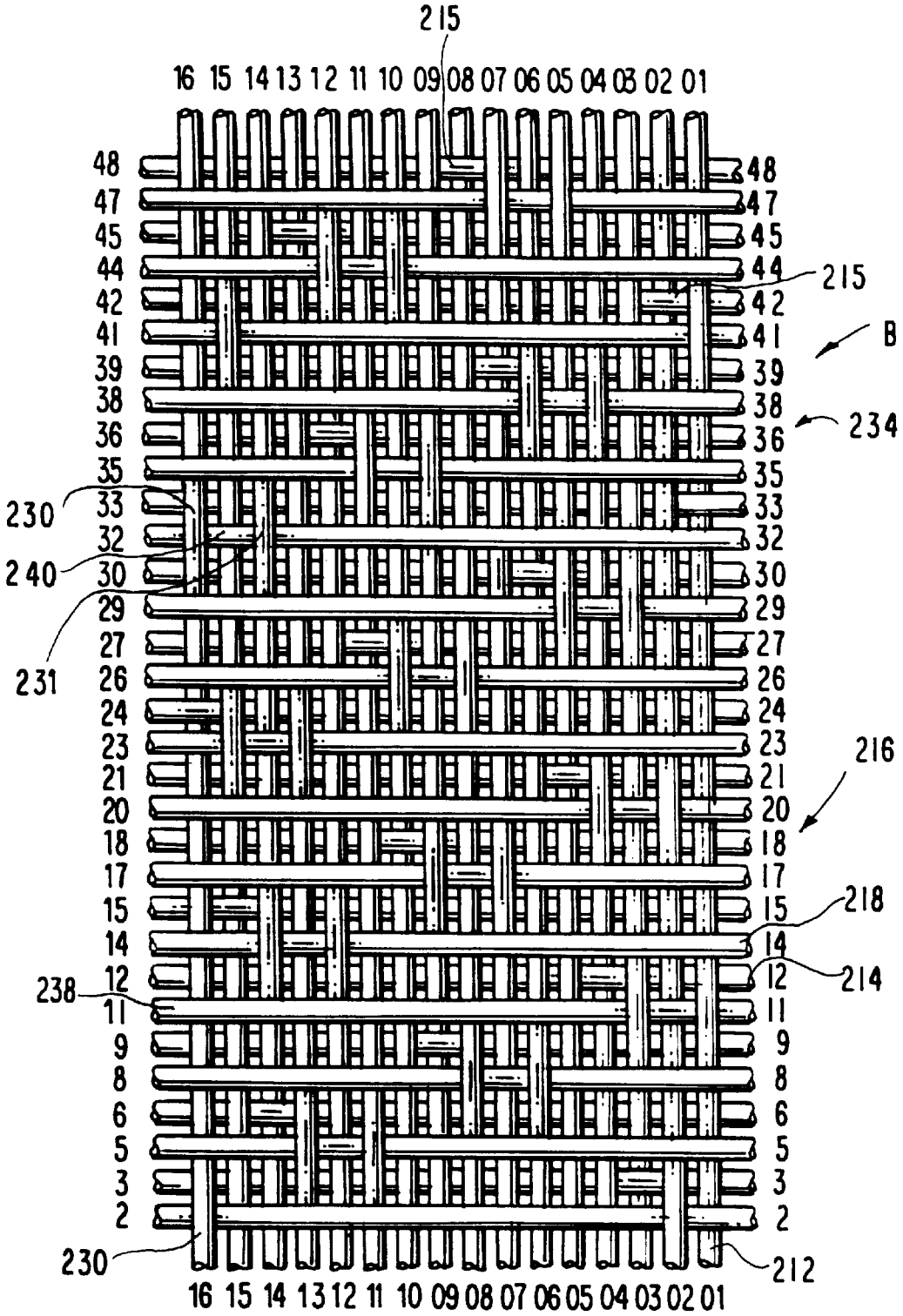
FIG. 6 is a sectional bottom view of the machine contact surface of the alternative arrangement of the papermaking fabric of the invention through a single repeat of the weave pattern.

Turning now to FIGS. 5–8, a second arrangement is shown for forming the papermaking fabric of the invention. FIG. 5 shown a full repeat of the weave pattern forming the paper support surface 210 of papermaking fabric B. Again, there are sixteen warp yarns 212, numbered 01–16, which are again controlled by sixteen harness frames to weave with upper layer weft yam 214 to form upper layer of support surface 210 of fabric B. FIG. 6 shows warp yarns 212 weaving with lower layer weft yarns 218 forming lower or contact surface 216.

Papermaking fabric B is also woven in a weave pattern which requires forty-eight picks of weft yarn 214 numbered 1–48 and sixteen ends of warp yarn 212 numbered 01–16. The weave also provides three crossovers for each warp yarn 212 through a repeat of the weave pattern at 244 on support surface 210. Warp yarn crossovers 244 are separated by warp yarn cross-unders 220 of four, five, nine, and ten picks of weft yarn 214.

Weft yarn 214 form weft floats 236 and 237 on the support surface on alternate picks over the weave pattern. Weft floats 236, 237 each pass over seven warp yarns 212 with two floats being formed on first picks through the weave pattern. Weft floats 239 pass over fifteen weft yarns and, are formed on second or alternate picks. There is only a single weft float 239 per pick in the weave pattern.

Crossovers 244 form diagonal or twill lines 232 across the weave pattern and weft floats 236, 237, and 239 form diagonal twill lines 233 across the weave pattern. Crossovers 244 are arranged adjacent intermediate portions of weft floats 239 and act to help stabilize the position of these floats in the fabric.

Contact surface 216, as shown in FIG. 6, is substantially identical to contact surface 116 of FIG. 2. The only difference is the location of support surface weft cross-unders 215 as they appear along each pick of upper weft 214 as indicated.

Figures 1, 7:
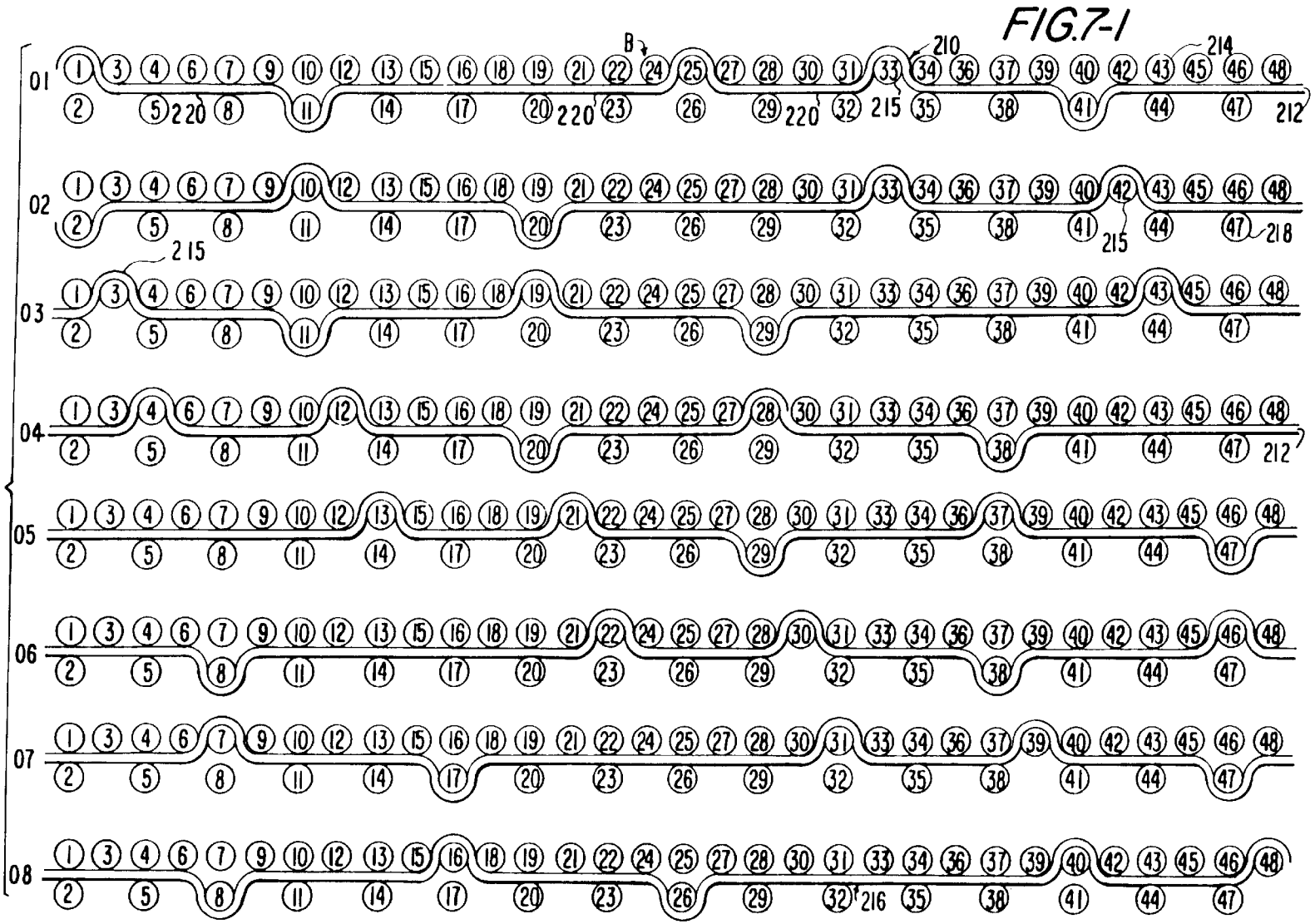
Figures 2, 7:
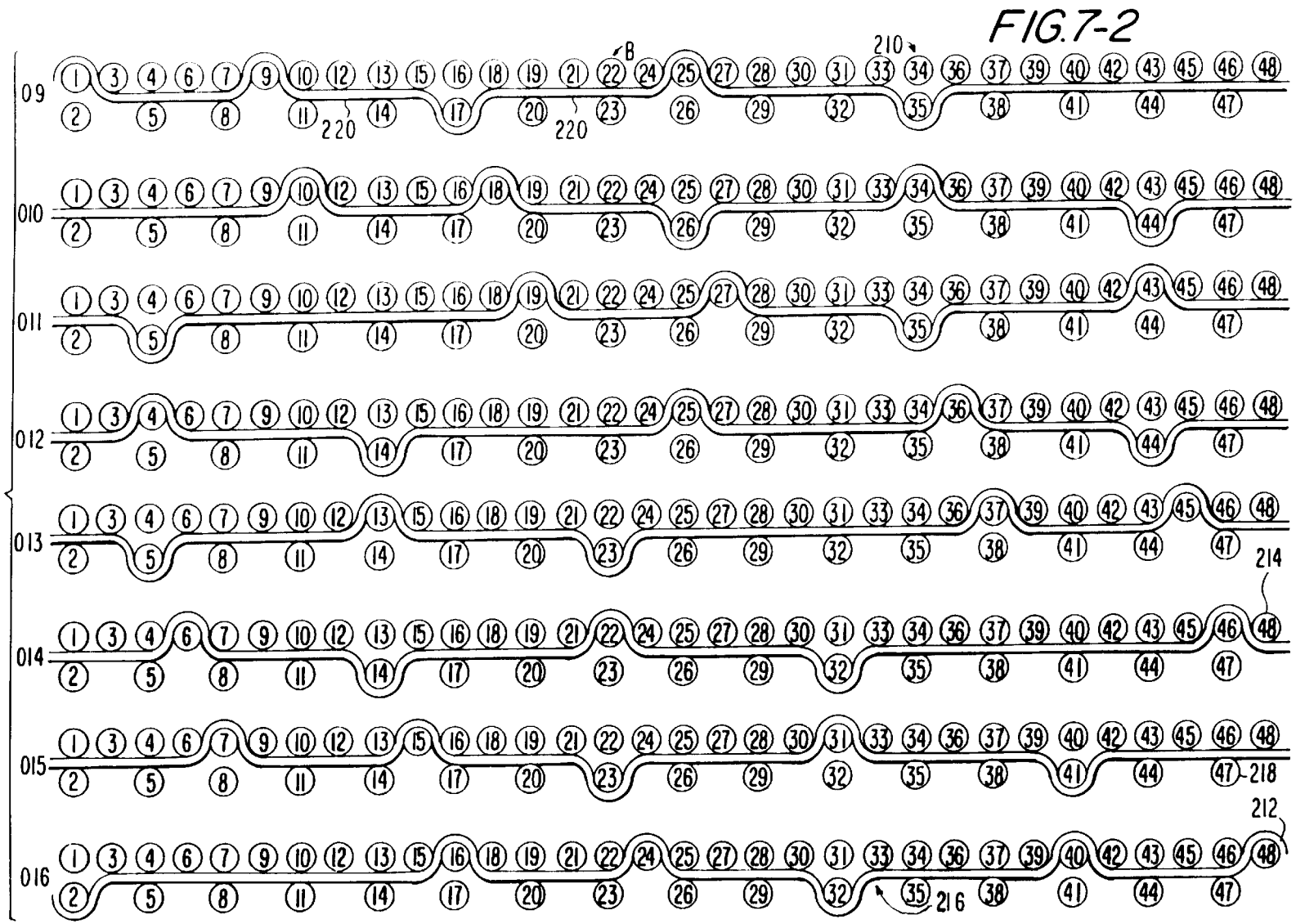

FIGS. 7-1 and 7-2, as FIGS. 3-1 and 3-2, show the interrelationship of each warp yarn 212 and each weft yarn 214 throughout the weave pattern.

Figure 8:
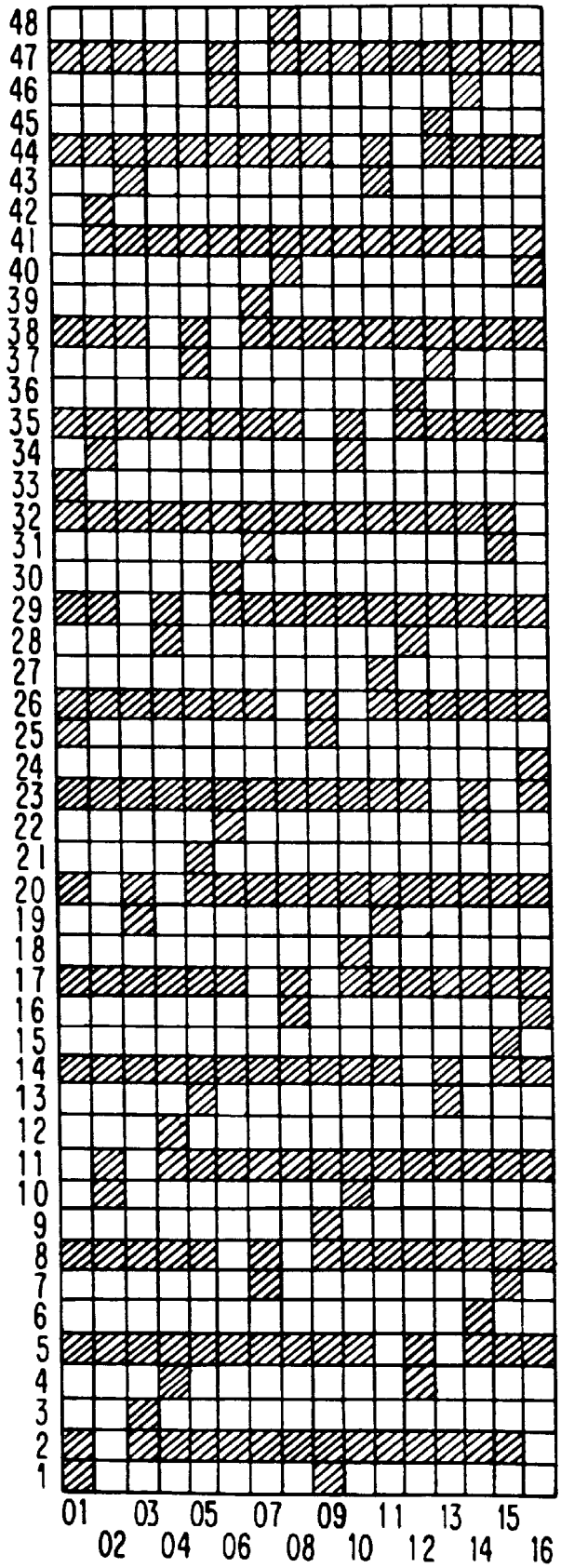
FIG. 8 is a weave diagram for the alternative arrangement of the papermaking fabric of the invention through a repeat of the weave pattern.

FIG. 8 is the weave diagram for forming papermaking fabric B.

Figure 9:
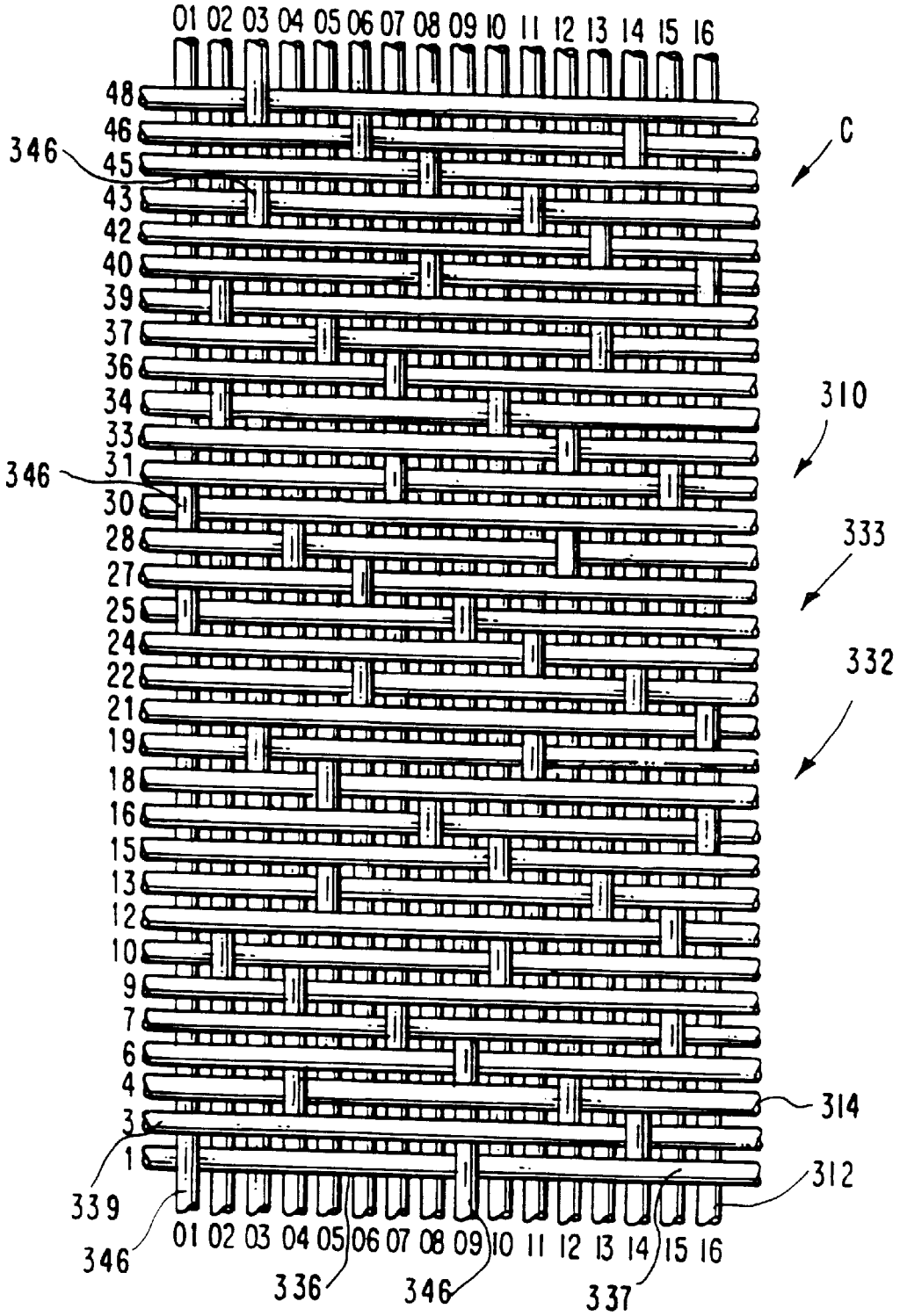
FIG. 9 is a sectional top view of the paper support surface of a second alternative arrangement of the papermaking fabric of the invention through a single repeat of the weave pattern.

Turning now to FIGS. 9–12 a third arrangement of the papermaking fabric of the invention is illustrated at C. FIG. 9 is a complete repeat of the weave pattern showing the outer or support surface 310 formed of sixteen ends of warp yarns 312 which are numbered 01–16 and which weave with upper layer weft yarn 314. The lower layer weft yam 318 weaves also with warp yarns 312 to form lower or machine contact surface 316. The weave pattern includes forty-eight picks, numbered 1–48, of weft yarn 314 and sixteen ends of warp yarn numbered 01-16.

Each warp yarn 312 weaves over three and under twenty-nine picks of upper weft yarn 314 in each weave pattern repeat forming three crossovers 346. Crossovers 346 are separated by fifteen, two, and twelve picks respectively. Crossover 346 are arranged over support surface 310 in such a manner that diagonal or twill lines 332 are formed across the width of the fabric.

Support surface 310 is a weft dominated surface with first picks forming weft floats 336 and 337 which pass over seven warp yarns 314 and are tied in with a pair of crossovers 346. Second picks which form weft floats 339 pass over fifteen warp yarns 314 and are tied in with a single crossover 346 per repeat of the weave pattern. The first and second picks are arranged in alternative manner over the support surface with crossovers 346 being positioned to engage and stabilize intermediate portions of weft floats 339. Again weft floats 336, 337, and 339 form diagonal twill lines 333 across the weave pattern and fabric.

Figure 10:
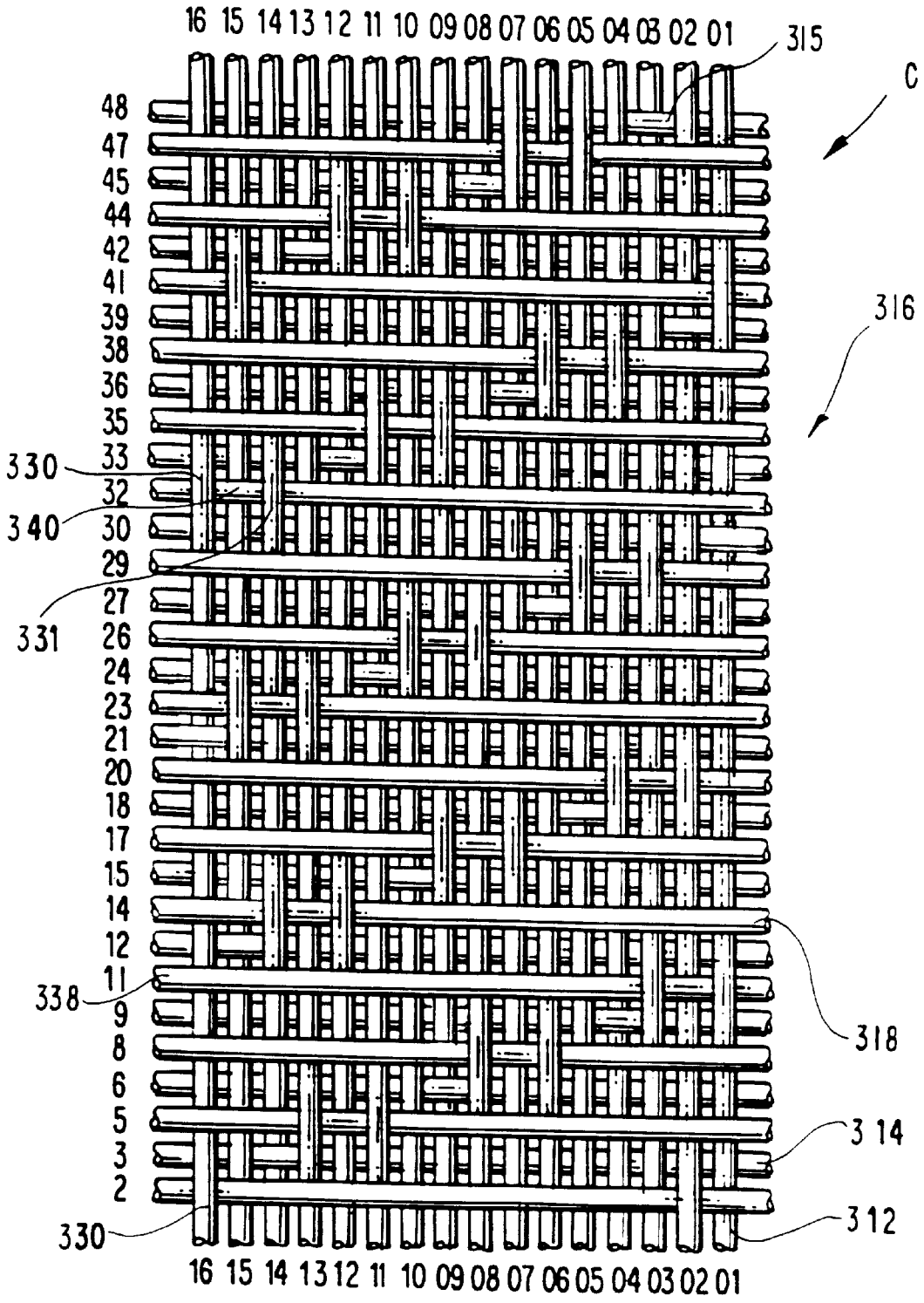
FIG. 10 is a sectional bottom view of the machine contact surface of the second alternative arrangement of the papermaking fabric of the invention.

FIG. 10 shows the contact surface 316 of papermaking fabric C which again is substantially identical with the surface of papermaking fabric A & B. Again the difference is the location of crossovers 315 as the upper layer weft 314 which appears on the contact surface.

Figures 1, 11:
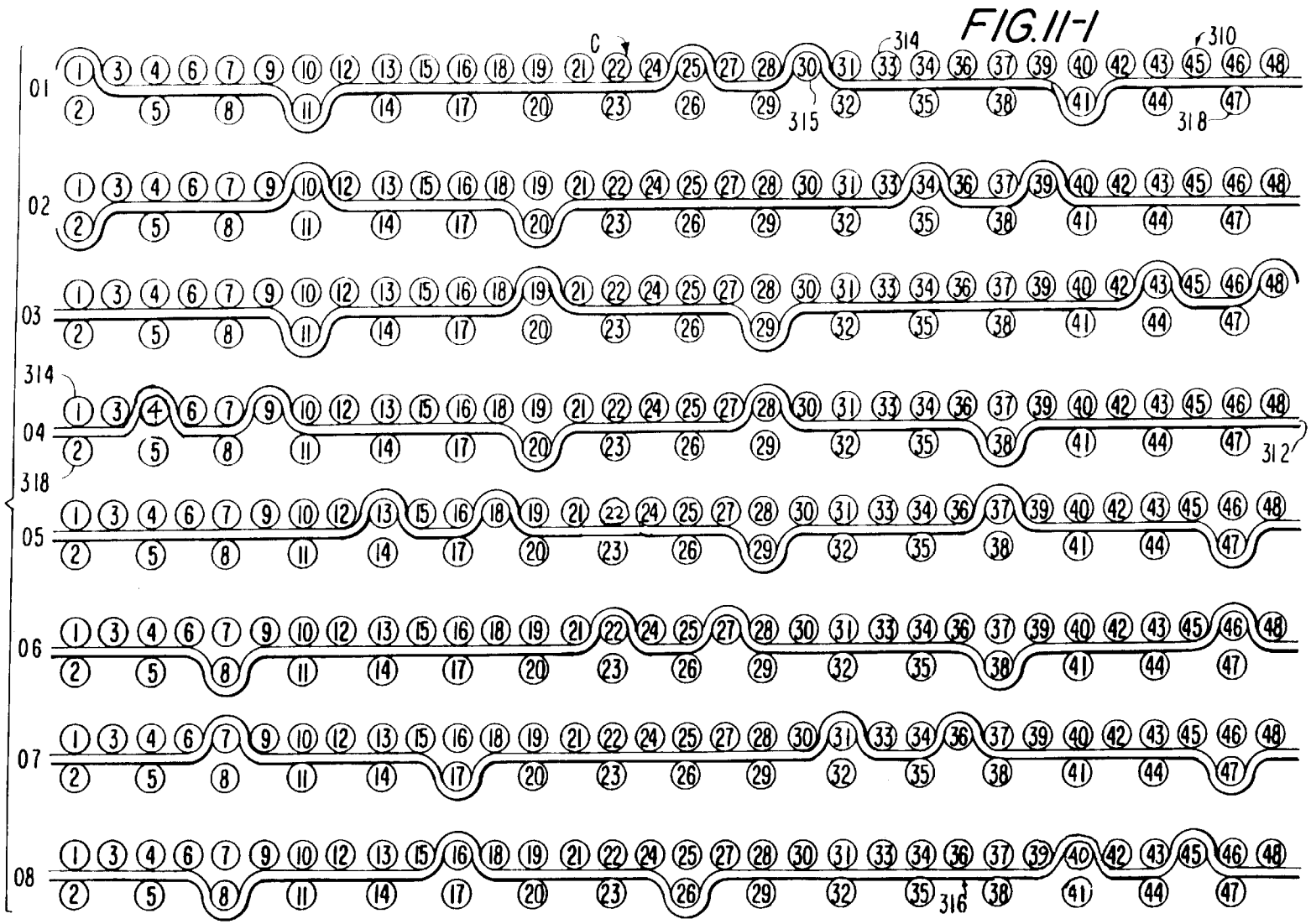
Figures 2, 11:
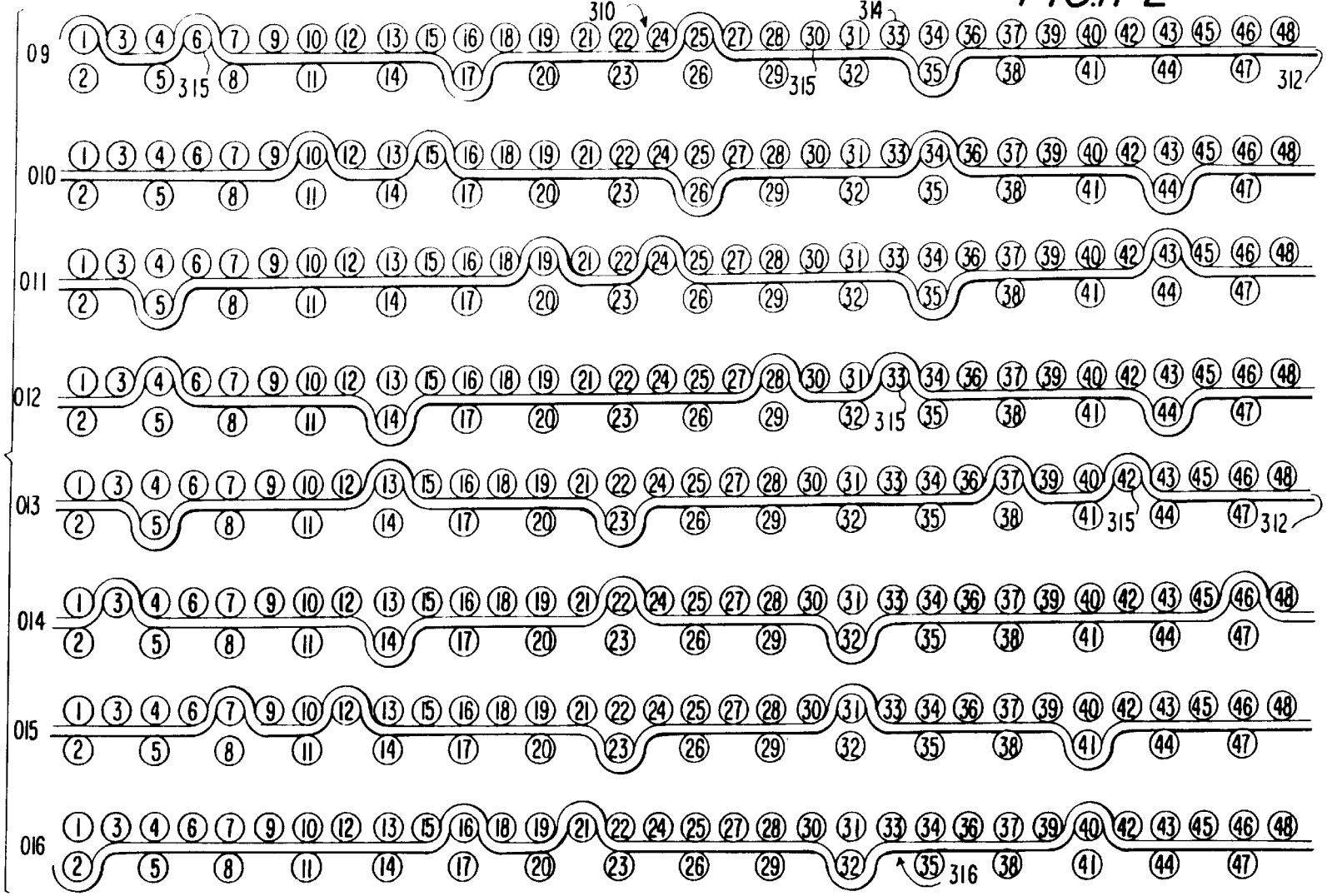

FIGS. 11-1 and 11-2 show the interrelationship of each warp yarn and each weft yarn throughout the weave pattern for fabric C.

Figure 12:
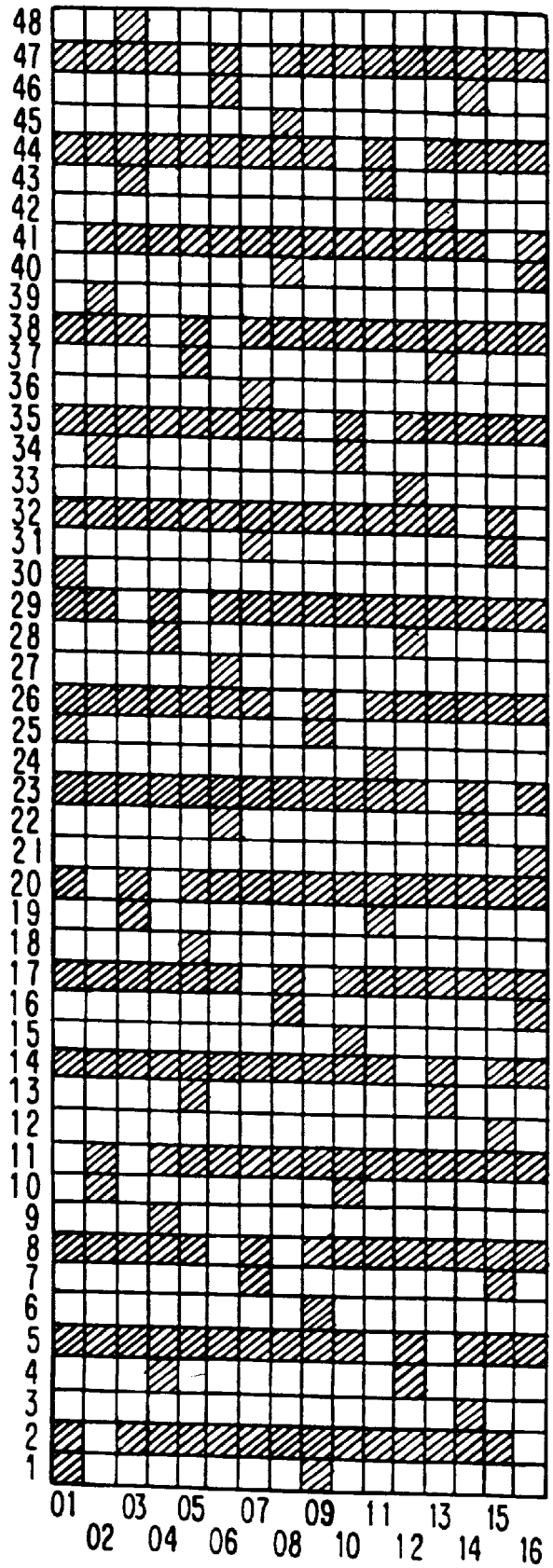

FIG. 12 shows the weave pattern.

The papermaking fabric structure as described provide even drainage throughout and the paper support surface and also forms a support surface which is even and smooth. The fabrics exhibit good stability due to the balanced weave patterns, provide a minimal number of evenly even distributed anchoring points, those points where the warp yarns pass over the upper weft yarns or under the lower weft yarns weft yarns, over both the paper support and machine surfaces.

The fabric, which is preferably a papermaking forming fabric, has been described as being woven flat with the warp yarns extending in the machine direction (MD) and the weft yarns extending in the cross machine direction (CMD). It is within the scope of the invention to weave the fabric continuous in which case the weft yarns would extend in the MD and the warp yarns in the CMD.

While preferred aspects of the invention have been described using specific terms, such description is for illustrative purposes only, and it is to be understood that changes and variations may be made without departing from the spirit or scope of the following claims.

What is claimed is:

1. A papermaking fabric formed in repeats of a weave pattern, said fabric comprising:

a lower layer having a selected number of lower CMD yarns per weave pattern repeat;

an upper layer having a selected number of upper CMD yarns per weave pattern repeat which is at least twice that of said lower layer;

a system of MD yarns interwoven in said weave pattern with said upper and lower CMD yarns;

each said MD yarn in each said weave pattern repeat interweaving to cross-under an even number of lower CMD yarns and to crossover an uneven number of upper CMD yarns, the number of said upper MD yarn crossovers being at least three fifths of the total of said MD yarn crossovers and cross-unders;

said MD yarn crossovers and cross-unders being arranged in twill arrays diagonally across said weave pattern to form upper and lower CMD yarn floats; wherein, said upper and lower CMD yarn floats are arranged in a twill pattern and form outer surfaces of said upper and lower layers weft dominant.

2. The fabric of claim 1 wherein selected of said upper CMD floats of said upper surface are tied in with a single crossover of said MD yarn at each end within said weave pattern and other of said upper CMD floats are tied in with a single crossover of said MD yarn at one end within said weave pattern.

3. The fabric of claim 2 wherein said selected and said other of said upper CMD floats are alternatingly arranged throughout the weave pattern.

4. The fabric of claim 1 wherein said uneven number of crossovers of each MD yarn comprises three.

5. The fabric of claim 4 wherein certain of said crossovers of each said MD yarn are separated by at least ten upper CMD yarns and other of said crossovers are separated by at least two upper CMD yarns per weave pattern repeat.

6. The fabric of claim 1 wherein each said lower CMD yarn of said lower layer forms one float beneath said MD yarns for each weave pattern repeat.

7. The fabric of claim 6 wherein each of said lower CMD floats on said lower layer are tied in with consecutive MD yarns which pass under, over, and under each said lower CMD yarn.

8. The fabric of claim 7 wherein said tie ins form twill lines across said lower layer.

9. The fabric of claim 1 wherein the number of upper CMD yarns in said weave pattern repeat is at least twice the number of lower CMD yarns in said weave pattern repeat.

10. The fabric of claim 1 wherein selected of said upper CMD yarns cross under selected MD yarns forming a cross-under which appears on said lower layer.

11. The fabric of claim 1 wherein no lower CMD yarn crossover appears on said upper layer.

12. A wear resistant dual layer papermaking fabric having an upper paper support surface and a lower machine contact surface, said fabric comprising:

a first plurality of picks of weft yarns weaving with a plurality of warp yarns to form, on said support surface, consecutive weft yarn floats passing over at least six adjacent warp yarns forming said support surface as a weft dominated surface, each of said warp yarns passing over an end of a selected weft yarn float tying in said float with said fabric, said warp yarn passovers forming a twill line diagonally across said support surface; and, a second plurality of picks of weft yarn weaving with said warp yarns forming a plurality of consecutive weft yarn floats of equal length beneath said warp yarns forming said contact surface, weft dominated;

and consecutive of said warp yarns tying in ends of said contact surface weft floats with a pass-under, a passover, and a pass-under.

13. The fabric of claim 12 wherein said fabric is formed in a weave pattern having sixteen warp yarns per weave pattern repeat.

14. The fabric of claim 12 wherein said fabric is formed in a weave pattern having forty-eight picks of weft yarn per weave pattern repeat.

15. The fabric of claim 12 wherein said weft yarns are of equal size.

16. The fabric of claim 12 wherein said weft yarns forming said support surface are of less diameter than said weft yarns forming said contact surface.

17. The fabric of claim 12 wherein each said weft yarn forming said contact surface is stacked beneath selected of said weft yarns forming said support surface.

18. The fabric of claim 12 wherein selected of said weft yarns forming said support surface appear on said contact surface at a cross-under of a selected of said warp yarns and no weft yarn crossover of said weft yarn forming said contact surface appears on said support surface.

19. The fabric of claim 12 wherein said first plurality of picks weave with said warp yarns in a first balanced weave pattern and said second plurality of picks weave with said warp yarns in a second balanced weave pattern.

20. A papermaking fabric formed in repeats of a weave pattern, said fabric comprising:

a lower layer having a selected number of CMD yarns per weave pattern repeat;

an upper layer having a selected number of CMD yarns per weave pattern repeat which is at least twice that of said CMD yarns of said lower layer;

a system of MD yarns interwoven in said weave pattern with said CMD yarns;

said upper layer CMD yarns in each said weave pattern repeat interweaving in first picks with said MD yarns to cross over a first number of MD yarns to form first floats and to cross over a second number of MD yarns with second picks to form second floats the number of MD yarn crossovers by said second floats being at least twice the number of MD yarn crossovers by each of said first floats;

said first and second floats being tied in with MD yarn crossovers, said MD yarn crossovers being arranged in twill arrays diagonally across said weave pattern; wherein, said upper layer of said fabric is comprised of a plurality of CMD yarn floats and MD yarn crossovers, each being arranged in a twill pattern.

21. The fabric of claim 20 wherein selected of said second CMD floats are tied in with a single crossover of a MD yarn in each weave pattern repeat and at least one of said first CMD yarn floats is tied in at each end within each said weave pattern with a single crossover of a MD yarn.

22. The fabric of claim 20 wherein said first and said second CMD yarn floats are alternatingly arranged throughout the weave pattern.

* * * * *